US010850414B2

(12) United States Patent
Oiwa

(10) Patent No.: US 10,850,414 B2
(45) Date of Patent: Dec. 1, 2020

(54) SHEET MATERIAL PROCESSING DEVICE AND SHEET MATERIAL PROCESSING APPARATUS

(71) Applicant: DUPLO SEIKO CORPORATION, Kinokawa (JP)

(72) Inventor: Hideki Oiwa, Kinokawa (JP)

(73) Assignee: DUPLO SEIKO CORPORATION, Kinokawa (JP)

( * ) Notice: Subject to any disclaimer, the term of this patent is extended or adjusted under 35 U.S.C. 154(b) by 152 days.

(21) Appl. No.: 15/160,619

(22) Filed: May 20, 2016

(65) Prior Publication Data

US 2016/0346945 A1 Dec. 1, 2016

(30) Foreign Application Priority Data

May 26, 2015 (JP) ..... 2015-106229
Mar. 29, 2016 (JP) ..... 2016-066153

(51) Int. Cl.
*B26D 1/08* (2006.01)
*B26D 9/00* (2006.01)
(Continued)

(52) U.S. Cl.
CPC ..... *B26D 1/085* (2013.01); *B26D 1/09* (2013.01); *B26D 3/085* (2013.01); *B26D 5/02* (2013.01);
(Continued)

(58) Field of Classification Search
CPC ..... B23D 15/02; B23D 15/04; B26D 1/085
(Continued)

(56) References Cited

U.S. PATENT DOCUMENTS 1,501,162 A * 7/1924 Cumfer ..... B26D 7/2614 30/349
4,685,363 A * 8/1987 Gerber ..... B26D 7/015 269/21
(Continued)

FOREIGN PATENT DOCUMENTS

JP H 10249788 A 9/1998
JP 2011110666 A 6/2011
(Continued)

OTHER PUBLICATIONS

Office Action (Notice of Reasons for Refusal) dated Nov. 12, 2019, by the Japanese Patent Office in corresponding Japanese Patent Application No. 2016-066153, and an English Translation of the Office Action. (8 pages).

*Primary Examiner* — Kenneth E Peterson
(74) *Attorney, Agent, or Firm* — Buchanan Ingersoll & Rooney P.C.

(57) ABSTRACT

A sheet material processing device 3 for performing processing on a having-been-conveyed sheet material along a direction perpendicular to the conveyance direction of the sheet material, includes: a blade member 4 including an upper blade part 42 and a lower blade part 41 that extend in the perpendicular direction and then pressing both blade parts 41 and 42 to each other so as to perform predetermined processing on the sheet material located between both blade parts; a pressing mechanism 5 for pressing both blade parts to each other; and a moving mechanism 6 for moving the blade member in the perpendicular direction, wherein in the upper blade part 42, a processing blade 421 is formed at one or more sites in the perpendicular direction, and wherein in the lower blade part 41, a receiving part for the processing blade is formed over the section facing the processing blade 421.

7 Claims, 13 Drawing Sheets

(51) Int. Cl.

| | |
|---|---|
| ***B26D 3/08*** | (2006.01) |
| ***B26F 1/02*** | (2006.01) |
| ***B26D 5/02*** | (2006.01) |
| ***B26F 1/18*** | (2006.01) |
| ***B26D 1/09*** | (2006.01) |
| *B26D 7/00* | (2006.01) |
| *B26F 1/20* | (2006.01) |
| *B26F 1/12* | (2006.01) |

(52) U.S. Cl.
CPC ..... *B26D 9/00* (2013.01); *B26F 1/02* (2013.01); *B26F 1/18* (2013.01); *B26D 2007/0068* (2013.01); *B26F 1/12* (2013.01); *B26F 1/20* (2013.01)

(58) Field of Classification Search
USPC ..... 83/694, 338, 916, 699.11, 614
See application file for complete search history.

(56) References Cited

U.S. PATENT DOCUMENTS 4,696,211 A * 9/1987 Bitzel ..... B21D 28/04 83/373
4,794,832 A * 1/1989 Trimble ..... B26D 3/003 83/153
5,251,523 A * 10/1993 Fisher ..... B26D 1/0006 83/155.1
6,109,154 A * 8/2000 Miyatsu ..... B26D 1/085 83/202
6,148,706 A * 11/2000 Witjes ..... B26D 1/245 83/488
6,729,214 B2 * 5/2004 Otsuka ..... B23D 15/00 83/56
7,815,382 B2 * 10/2010 Monclus ..... B26D 1/0006 400/621
8,651,002 B2 * 2/2014 Sato ..... B26D 1/085 83/582
2002/0134209 A1 * 9/2002 Burman ..... B26D 7/20 83/39
2011/0226111 A1 * 9/2011 Bird ..... B26D 1/0006 83/640

FOREIGN PATENT DOCUMENTS

JP 2013049126 A 3/2013
JP 2013-230526 A 11/2013
JP 2015047657 A 3/2015

* cited by examiner

SHEET MATERIAL PROCESSING DEVICE AND SHEET MATERIAL PROCESSING APPARATUS

BACKGROUND OF THE INVENTION

1. Technical Field

The present invention relates to: a sheet material processing device for performing processing on a having-been-conveyed sheet material along a direction (referred to as a "width direction", hereinafter) perpendicular to the conveyance direction of the sheet material; and a sheet material processing apparatus employing this sheet material processing device. Here, employable sheet materials include a paper sheet, a resin thin plate, a film, and so on.

2. Background Art

As a sheet material processing device for performing processing on a having-been-conveyed sheet material along a width direction of the sheet material, for example, a processing device disclosed in Patent Document 1 is known. This processing device includes a revolving-type perforation processing blade that moves in the width direction. With moving in the width direction, the processing blade goes into contact with the sheet material at a processing position and departs from the sheet material at a non-processing position.

3. Prior Art References

Patent Document 1: JP Laid-open Publication No. 2013-230526

SUMMARY OF THE INVENTION

Problems to be Solved by the Invention

Nevertheless, in the processing device of Patent Document 1, processing is performed with moving the processing blade in the width direction and hence the moving time of the processing blade is included in the processing time. Thus, the processing time becomes long and a limit is placed on the processing efficiency.

On the other hand, when the processing in the width direction is performed by employing a so-called "guillotine blade", the processing time becomes short. Nevertheless, in the "guillotine blade", position adjustment in the width direction cannot be performed. Thus, even when a deviation is present in the processing position, correction for this cannot be performed and hence a problem remains in the accuracy. Further, in the "guillotine blade", it is difficult to change the processing blade alone and hence difficult to deal with various kinds of processing.

An object of the present invention is to provide a sheet material processing device and a sheet material processing apparatus capable of performing processing in the width direction with accuracy and satisfactory processing efficiency.

Means for Solving the Problem

The present invention includes the following inventions [1] to [8].

[1] A sheet material processing device for performing processing on a having-been-conveyed sheet material along a direction perpendicular to a conveyance direction of the sheet material, comprising:

a blade member including an upper blade part and a lower blade part that extend in the perpendicular direction and then pressing the both blade parts to each other so as to perform predetermined processing on the sheet material located between the both blade parts;

a pressing mechanism for pressing the both blade parts to each other; and a moving mechanism for moving the upper blade part and/or the lower blade part of the blade member in the perpendicular direction, wherein in one of the upper blade part and the lower blade part, a processing blade for performing the predetermined processing is formed at one or more sites in the perpendicular direction, and wherein in the other one of the upper blade part and the lower blade part, a receiving part for the processing blade or alternatively a processing blade for performing the predetermined processing is formed at least over a section facing the processing blade.

[2] The sheet material processing device according to [1], wherein the blade member is constructed such that the predetermined processing is performed at the one or more sites at once by one time of pressing operation of the both blade parts.

[3] The sheet material processing device according to [1] or [2], wherein the blade member is provided in an attachable and detachable manner.

[4] The sheet material processing device according to [3], wherein the blade member is constructed in an attachable and detachable manner by means of a sliding mechanism.

[5] The sheet material processing device according to any one of [1] to [4], wherein the blade member is arbitrarily selected from two or more types of blade members different from each other in the type of processing of the processing blade and/or the position of the processing blade in a width direction and/or the number of processing blades.

[6] The sheet material processing device according to [1], wherein:

in one of the upper blade part and the lower blade part, a processing blade for performing the predetermined processing is formed at one or more sites in the perpendicular direction;

in the other one of the upper blade part and the lower blade part, a receiving part for the processing blade or alternatively a processing blade for performing the predetermined processing is formed entirely in the perpendicular direction; and the moving mechanism moves the one of the upper blade part and the lower blade part in the perpendicular direction.

[7] A sheet material processing apparatus comprising a sheet material processing device according to any one of [1] to [6], whereby a sheet material is conveyed and then predetermined processing is performed thereon by the sheet material processing device.

[8] The sheet material processing apparatus according to [7], wherein the sheet material processing device is attachable and detachable relative to the apparatus body.

Effect of the Invention

According to the present invention, the blade member can be moved in the perpendicular direction. Thus, when the sheet material having been conveyed is deviated in the width direction, the blade member can be located in a correct position in the width direction relative to the sheet material. Thus, processing in the width direction can accurately be performed.

DETAILED DESCRIPTION

Figure 1:
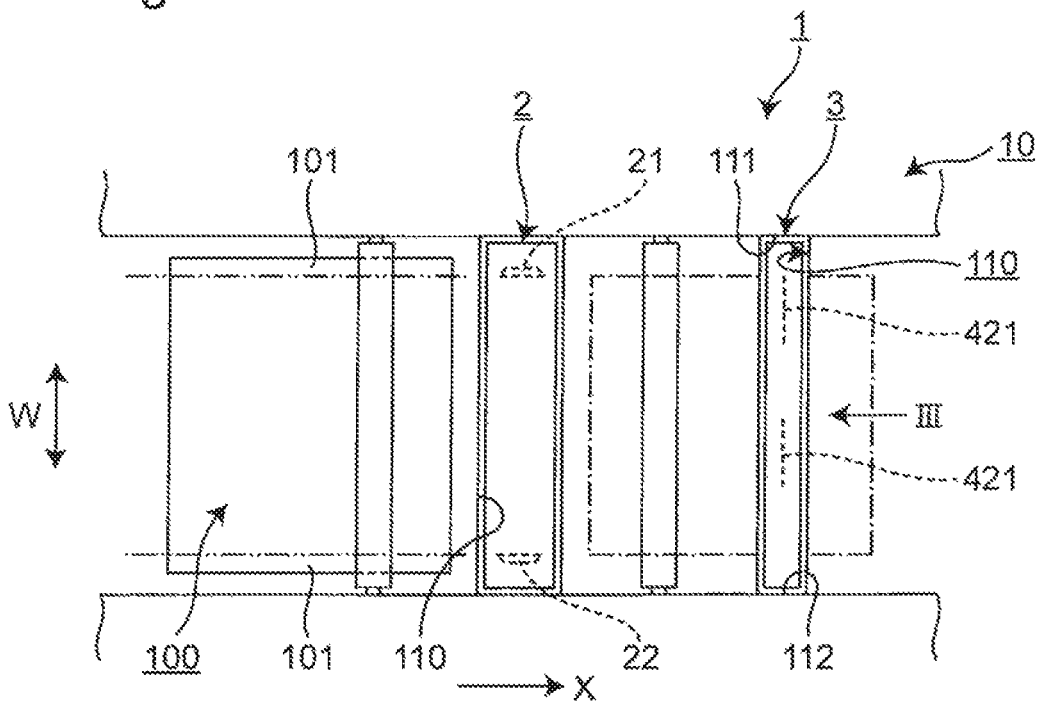
FIG. 1 is a schematic plan view showing a sheet material processing apparatus provided with a sheet material processing device of an embodiment of the present invention.

FIG. 1 is a schematic plan view showing a sheet material processing apparatus provided with a sheet material processing device of an embodiment of the present invention. The sheet material processing apparatus 1 includes at least an edge part cutting device 2 and the sheet material processing device 3. Then, in a state that a sheet material 100 is conveyed in the X-direction, the edge part cutting device 2 performs processing on the sheet material 100. After that, in the sheet material processing device 3, conveyance of the sheet material 100 is stopped at a processing position and then processing is performed on the sheet material 100. Then, the sheet material 100 is conveyed and ejected. Here, the conveyance in the X-direction (the conveyance direction) is performed by conveying rollers provided at appropriate positions located at least on a conveyance directional upstream side of the edge part cutting device 2, between the edge part cutting device 2 and the sheet material processing device 3, and on a conveyance directional downstream side of the sheet material processing device 3.

The edge part cutting device 2 is constructed such that rotary blades 21 and 22 cut both edge parts 101 of the sheet material 100 along the conveyance direction X.

The sheet material processing device 3 is constructed such as to form perforations along the width direction W perpendicular to the conveyance direction X. Further, the sheet material processing device 3 is constructed such as to form the perforations not over the entirety of the width direction W but at predetermined sites (two sites, in this example) in the width direction W.

Figure 2:
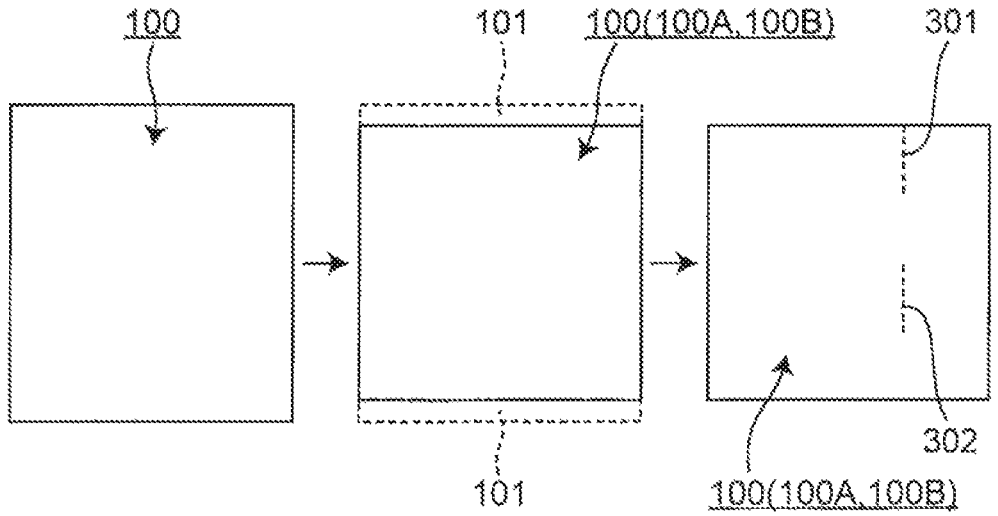
FIG. 2 is a schematic plan view showing a situation of processing of a sheet material in a sheet material processing apparatus.

That is, in the sheet material processing apparatus 1, as shown in FIG. 2, first, both edge parts 101 are separated from the sheet material 100 by the edge part cutting device 2 and then perforations 301 and 302 are formed at two sites of the sheet material 100 by the sheet material processing device 3.

Figure 3:
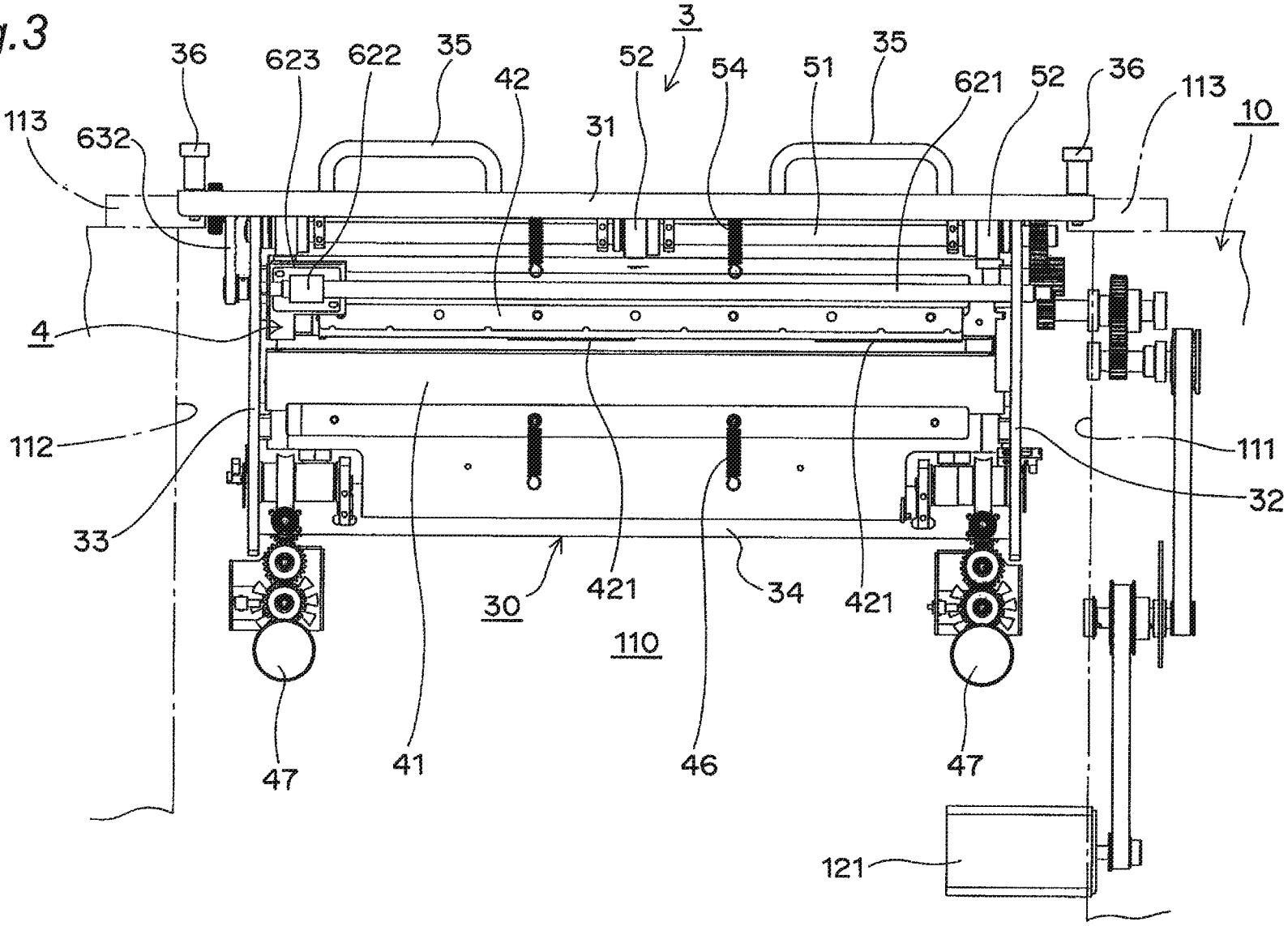
FIG. 3 is a view of a sheet material processing device taken in an arrow III direction in FIG. 1.
Figure 4:
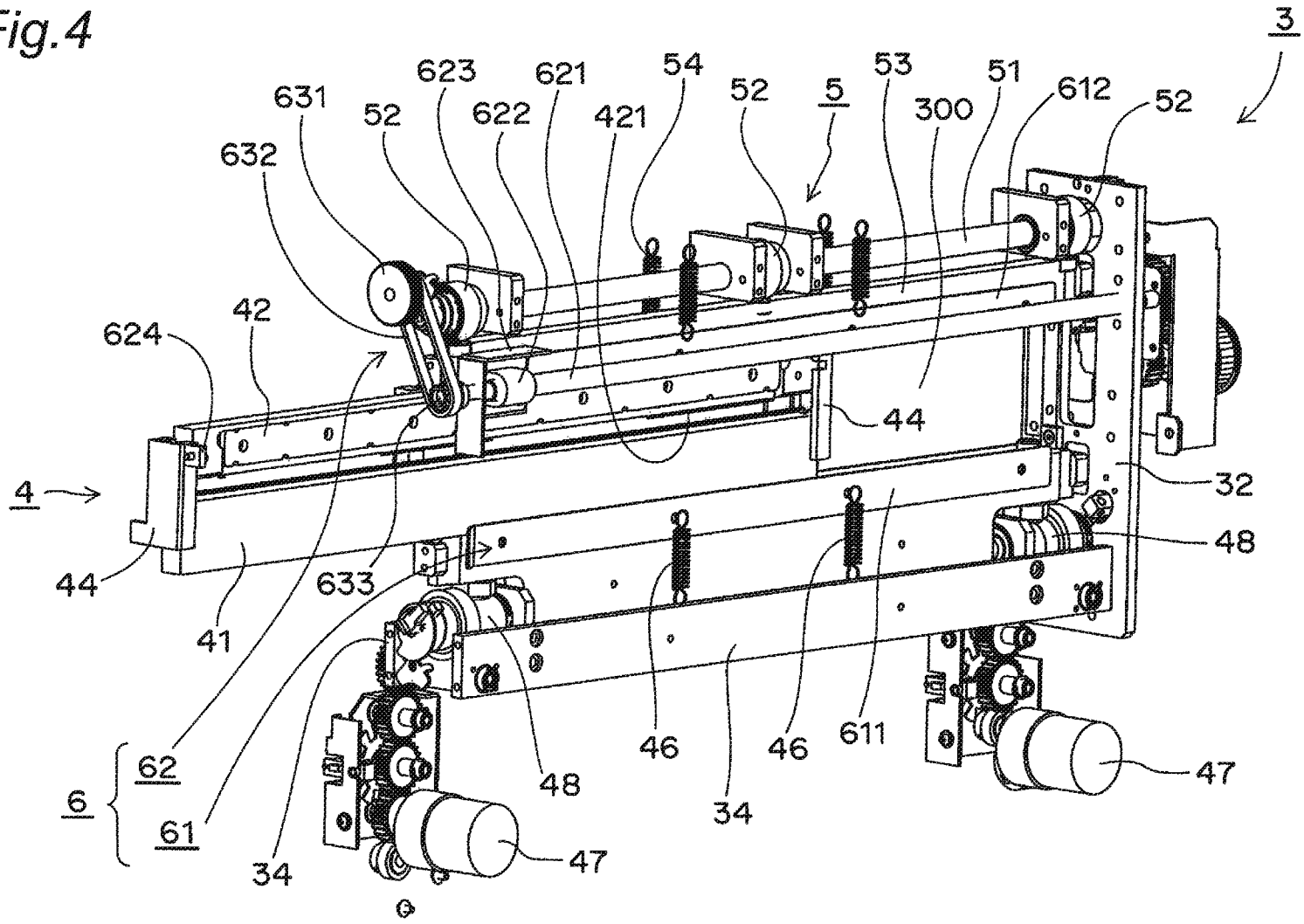
FIG. 4 is an exploded perspective view of a sheet material processing device.

FIG. 3 is a view of the sheet material processing device 3 taken in the arrow III direction in FIG. 1. FIG. 4 is an exploded perspective view of the sheet material processing device 3. As shown also in FIG. 1, the sheet material processing device 3 is used in a state of being provided in the inside of a receiving part 110 of an apparatus body 10 of the sheet material processing apparatus 1. The receiving part 110 has both walls 111 and 112 in the width direction.

In the sheet material processing device 3, an outer frame 30 is constructed from: a top plate 31; a right side plate 32 and a left side plate 33 hung from both end parts of the top plate 31; and a bottom frame 34 for linking together the lower end parts of both side plates 32 and 33. The upper face of the top plate 31 is provided with two handles 35 to be gripped at the time that the sheet material processing device 3 is installed in the inside of the receiving part 110. Further, a finger screw 36 each is provided at both ends in the width direction of the top plate 31. Then, at the time of installation in the inside of the receiving part 110, the sheet material processing device 3 can be fixed to a block 113 fixed to the upper parts of both walls 111 and 112 of the apparatus body 10, in an attachable and detachable manner with the finger screws 36. Here, for simplicity of description, the left side plate 33 is not shown in FIG. 4.

(Blade Member)

In the sheet material processing device 3, a blade member 4 is provided in an inner space 300 (FIG. 4) of the outer frame 30. The blade member 4 includes a lower blade part 41 and an upper blade part 42 extending in the width direction. The blade member 4 is constructed such that the upper blade part 42 is pressed against the lower blade part 41 so that predetermined processing is performed on the sheet material located between both blade parts 41 and 42. In the upper blade part 42, a processing blade 421 for performing predetermined processing is formed at one or more sites in the width direction. Here, the processing is formation of perforations and the upper blade part 42 includes perforation blades serving as the processing blades 421 formed at two sites in the width direction.

The upper blade part 42 is always biased toward a direction departing from the lower blade part 41, that is, upward, by springs (not shown) arranged between the upper blade part 42 and the lower blade part 41. The lower blade part 41 and the upper blade part 42 are held integrally with each other by vertical covers 44 provided at both ends. The upper blade part 42 is slidable in the up and down directions along the vertical covers 44.

(Pressing Mechanism)

In the sheet material processing device 3, a pressing mechanism 5 for pressing the upper blade part 42 against the lower blade part 41 is provided above the blade member 4. The pressing mechanism 5 includes a revolving shaft 51 extending in the width direction; eccentric cams 52 fixed to the revolving shaft 51; and a pressing bar 53 extending in the width direction. The revolving shaft 51 is linked to a motor 121 provided on the apparatus body 10 side. In this example, the eccentric cams 52 are provided in the center and at both ends of the revolving shaft 51. The pressing bar 53 is provided under the eccentric cams 52 and above the upper blade part 42 and then biased upward by springs 54 such as to abut against the eccentric cams 52 from the underside. Here, a member for locking an end part of each spring 54 is not shown in the figure. Both ends of the pressing bar 53 are located in the insides of vertical slide receiving parts (not shown). By virtue of this, the pressing bar 53 is held in a movable manner in the up and down directions. The pressing mechanism 5 is constructed such that the eccentric cams 52 are revolved in association with the revolving shaft 51 so that the pressing bar 53 is lowered and then the pressing bar 53 presses the upper blade part 42 against the lower blade part 41.

(Moving Mechanism)

In the sheet material processing device 3, a moving mechanism 6 for moving the blade member 4 in the width direction is provided on a conveyance directional downstream side of the blade member 4. The moving mechanism 6 is constructed from a support part 61 and a drive part 62.

Figure 5:
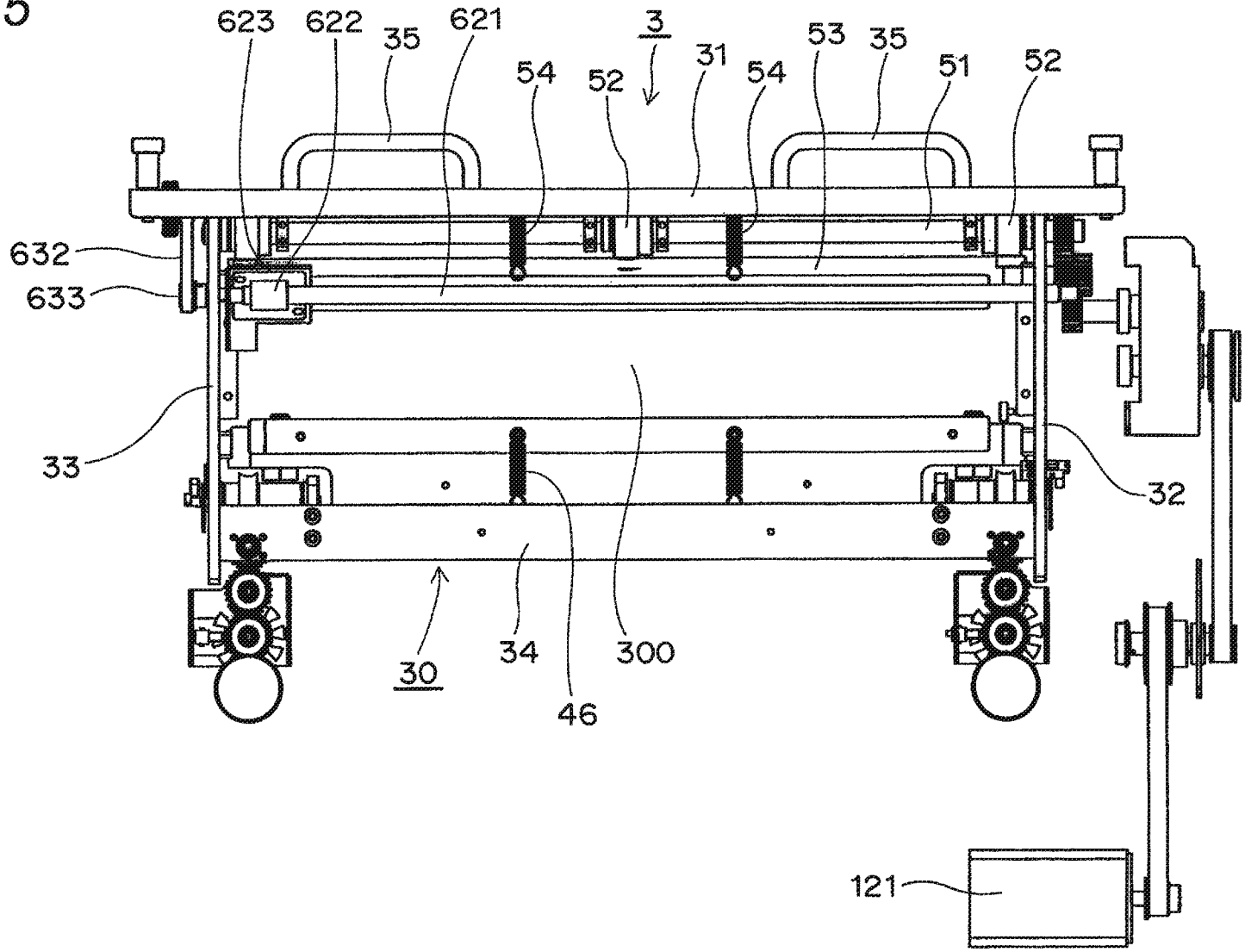
FIG. 5 is a front view of a sheet material processing device in a state that a blade member has been removed.

The support part 61 supports the blade member 4 in a manner that the blade member 4 can be moved in the width direction within the inner space 300 by a sliding mechanism. The support part 61 includes: a slide receiving part 611 provided such as to pinch the lower blade part 41 from the upstream and the downstream of the conveyance direction and extending in the width direction; and a slide receiving part 612 provided such as to pinch the upper blade part 42 from the upstream and the downstream of the conveyance direction and extending in the width direction. That is, the support part 61 includes the sliding mechanism. By virtue of this, as shown in FIG. 4, the blade member 4 can slide in the width direction and hence can move in the width direction within the inner space 300. Further, the blade member 4 is attachable and detachable relative to the outer frame 30 through a side plate opening part (not shown) of the left side plate 33. FIG. 5 is a front view of the sheet material processing device 3 in a state that the blade member 4 has been removed.

The drive part 62 includes: a threaded shaft 621 extending in the width direction; a nut 622 provided at the left end of the threaded shaft 621; a cover member 623 provided integrally with the nut 622; and a magnet 624 for joining the vertical covers 44 of the blade member 4 to the cover member 623 in an attachable and detachable manner. By virtue of a motor (not shown) provided on the apparatus body 10 side, the drive part 62 revolves the threaded shaft 621 via a gear 631, a belt 632, and a pulley 633 so as to move the nut 622 relatively to the threaded shaft 621 and thereby move the blade member 4 together with the cover member 623 and the vertical covers 44 in the width direction.

Here, the slide receiving part 611 of the lower blade part 41 is capable of up and down movement relative to the outer frame 30, then biased downward by springs 46, and then pushed up by a cam mechanism 48 linked to a motor 47. By virtue of this, in the lower blade part 41, the up-down position can be adjusted. Here, a member for locking an end part of each spring 46 is not shown in the figure.

Figure 6:
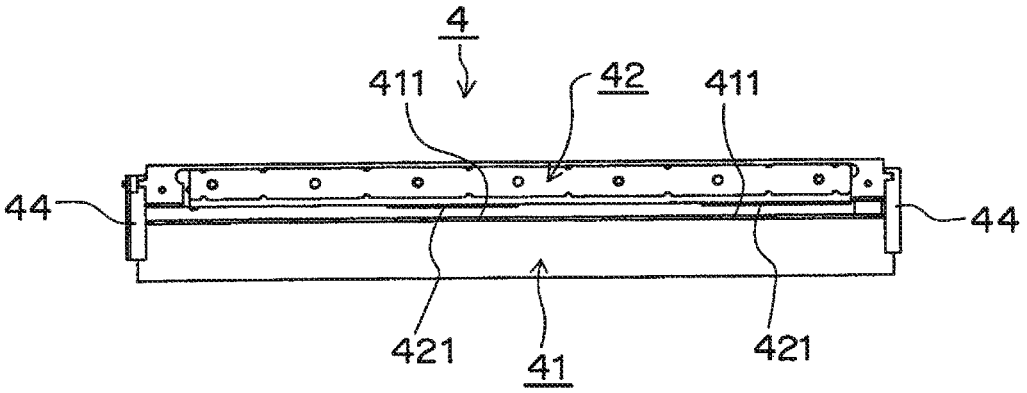
FIG. 6 is a front view of a blade member removed from a sheet material processing device.

FIG. 6 is a front view of the blade member 4 removed from the sheet material processing device 3. In the upper blade part 42, among sections obtained by dividing into four in the width direction, the second and the fourth section from the left are provided with the processing blade 421. Here, in the lower blade part 41, a receiving part 411 for the processing blade 421 is provided at least over the section facing the processing blade 421 of the upper blade part 42 from the underside.

(Operation Effect)

According to the sheet material processing apparatus 1 having the above-mentioned configuration, the following effects are obtained.

Figure 7:
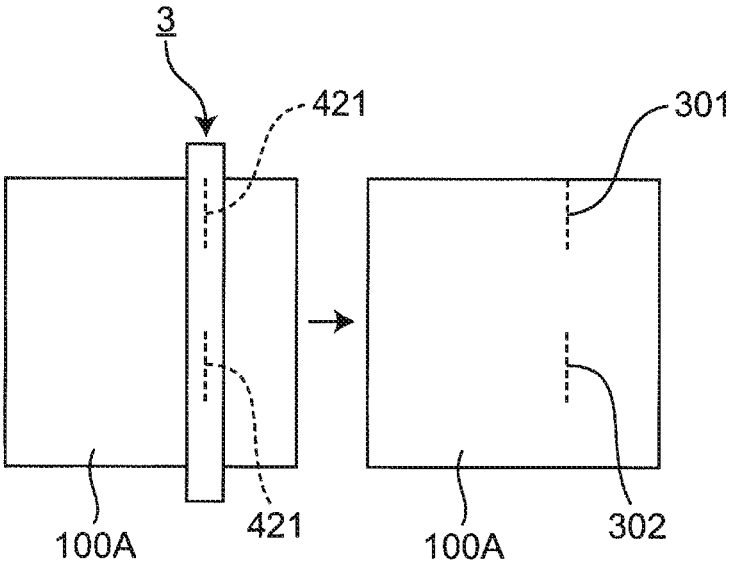
FIG. 7 is a schematic plan view showing a situation of processing of a sheet material in a sheet material processing device.

(1) Both edge parts 101 can be detached from the sheet material 100 by the edge part cutting device 2 and, after that, perforations 301 and 302 can be formed in the sheet material 100A at two sites in the width direction by the sheet material processing device 3. At that time, in the sheet material processing device 3, when the upper blade part 42 is pressed against the lower blade part 41 merely once, the perforations 301 and 302 can be formed at once at two sites as shown in FIG. 7. This improves the processing efficiency of the sheet material processing device 3 and hence the processing efficiency of the sheet material processing apparatus 1.

Figure 8:
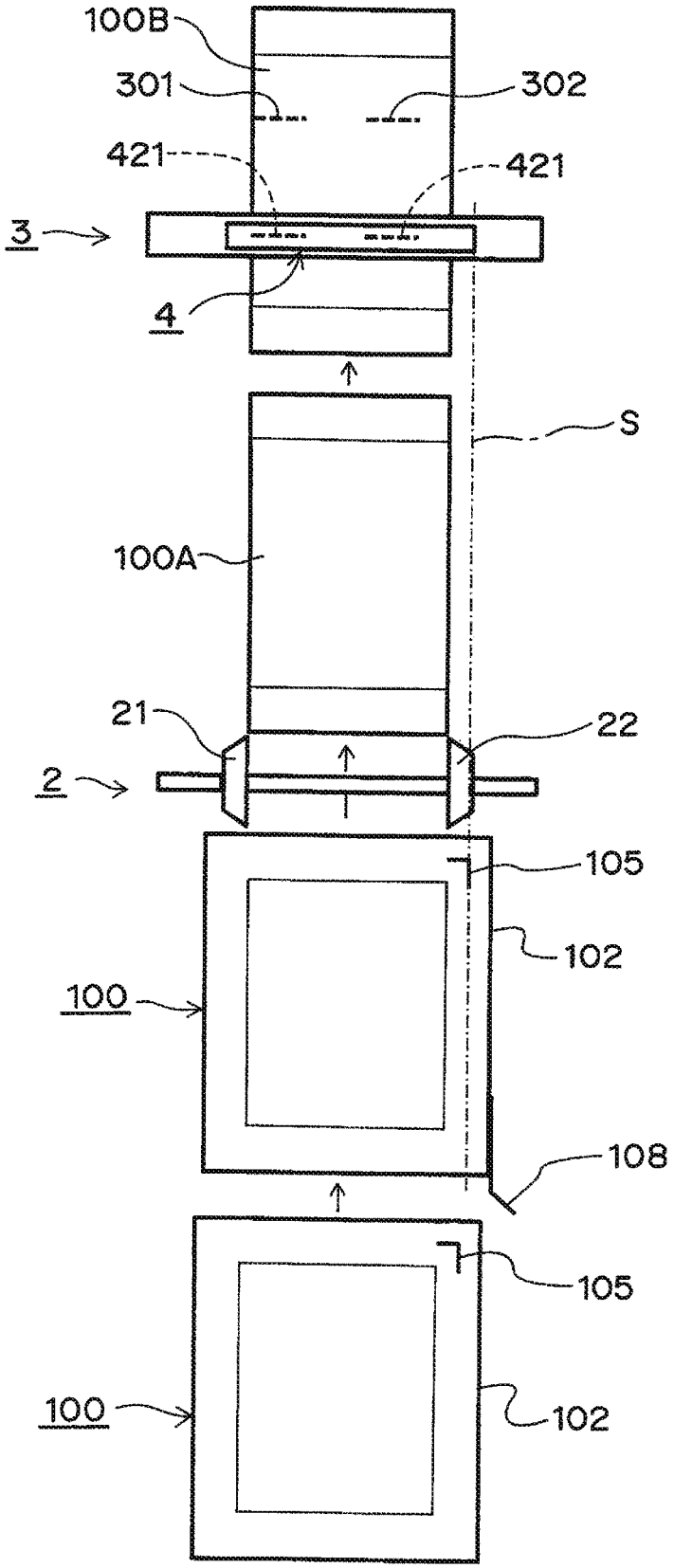
FIG. 8 is a schematic plan view showing a situation of processing of a sheet material in a sheet material processing apparatus.
Figure 9:
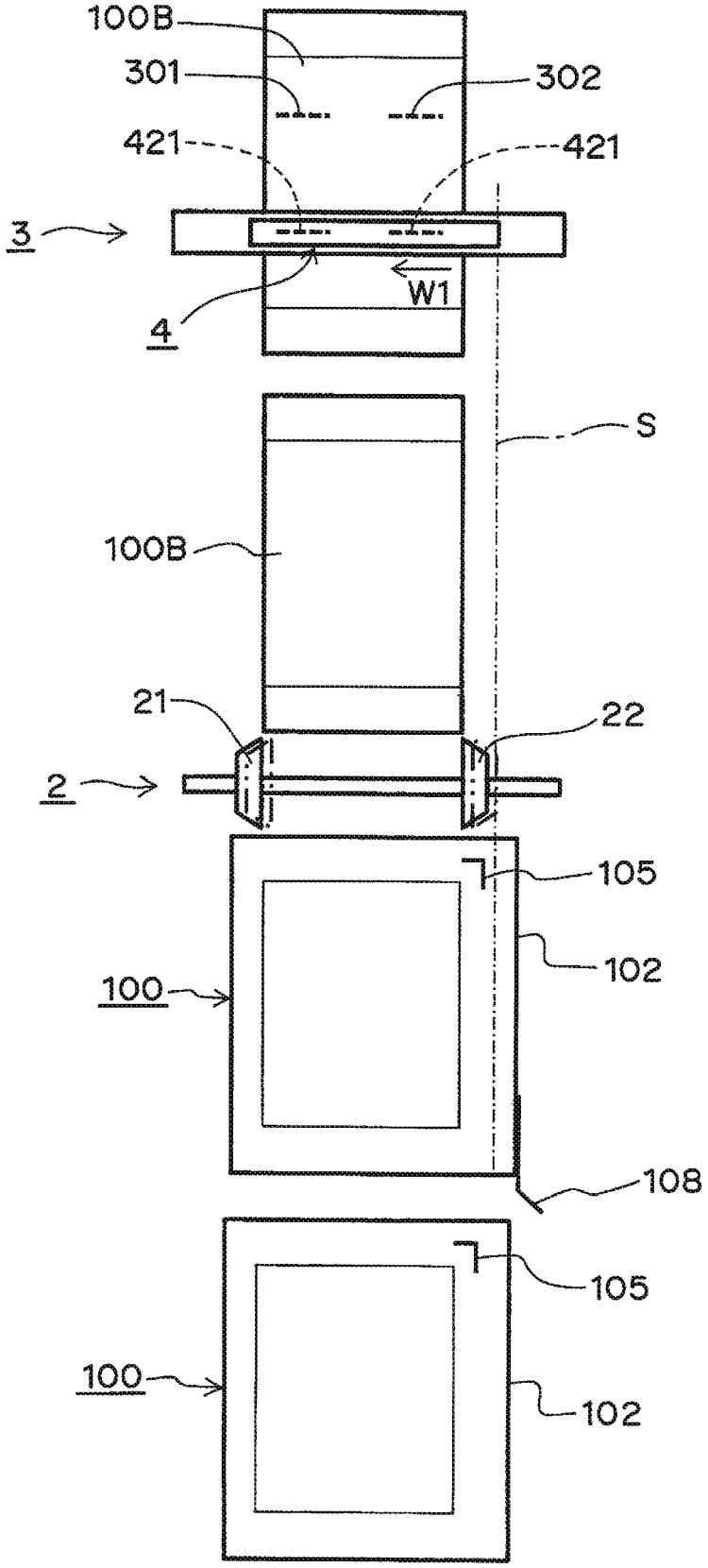
FIG. 9 is a schematic plan view showing a situation similar to that shown in FIG. 8 but of a case that the sheet material processing device does not satisfactorily operate.
Figure 10:
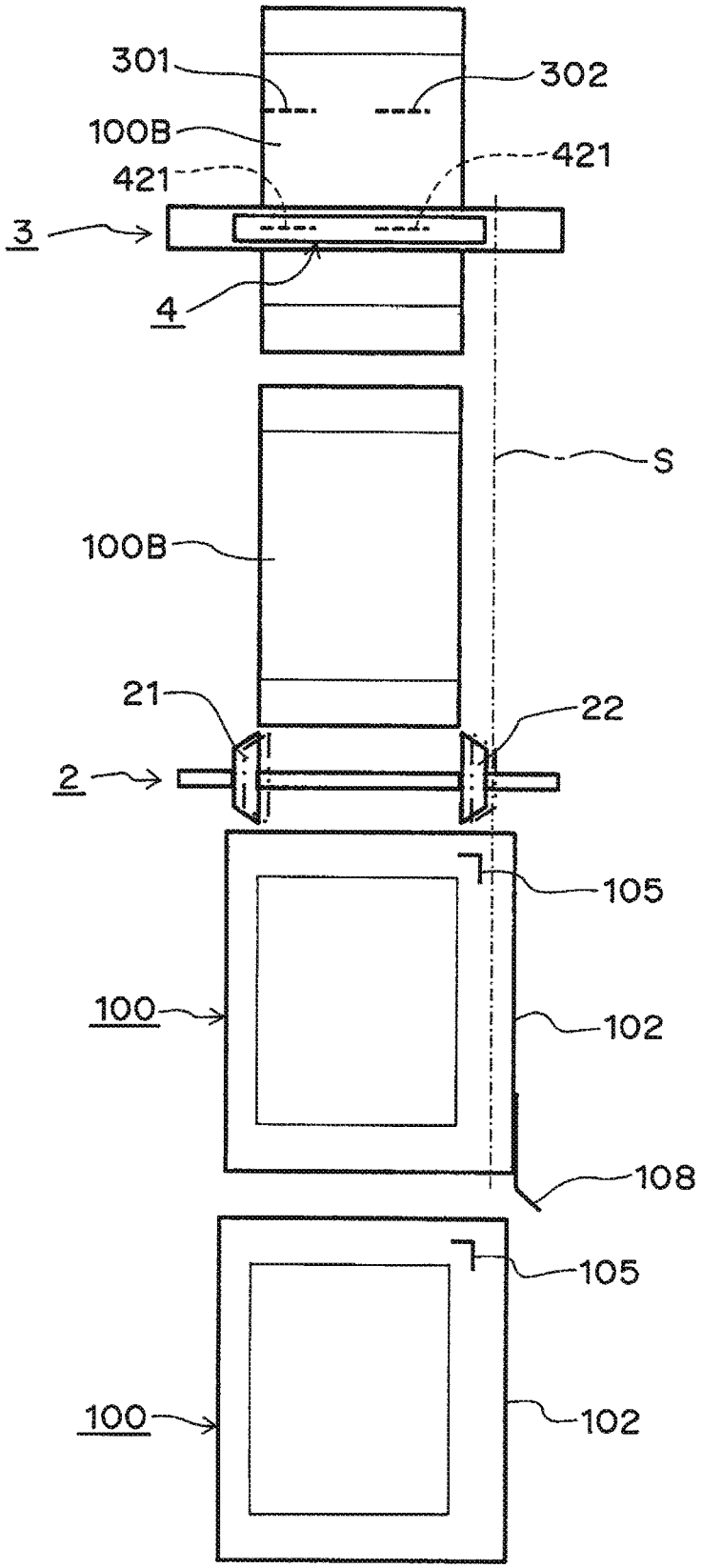
FIG. 10 is a schematic part plan view showing a situation that the sheet material processing device satisfactorily operates in the situation of FIG. 9.

(2) In general, as shown in FIG. 8, in the sheet material 100, a cut mark 105 is printed at a position of a predetermined distance from a side edge 102 that slides along a conveyance reference guide 108. When the cut mark 105 is printed at a correct position (the reference S), as shown in FIG. 8, the sheet material 100A having been cut by the edge part cutting device 2 is at a correct position in the width direction relative to the sheet material processing device 3. Thus, the perforations 301 and 302 are formed at desired positions. Nevertheless, during a printing process for a large number of the sheet materials 100, occurrence of a situation that the cut mark 105 is printed at a position deviated from the correct position (the reference S) as shown in FIG. 9 is not so rare. In such a case, as shown in FIG. 9, the rotary blades 21 and 22 of the edge part cutting device 2 move in the width direction to the position of the cut mark 105 and then perform cutting so that a sheet material 100B is formed from the sheet material 100. Nevertheless, the sheet material 100B is deviated from the reference S. Thus, when the sheet material processing device 3 operates in that state, the perforations 301 and 302 are formed at positions deviated from desired ones. However, according to the sheet material processing device 3 having the above-mentioned configuration, the moving mechanism 6 can move the blade member 4 in the width direction (in the W1 direction in FIG. 9). Thus, as shown in FIG. 10, the blade member 4 can be arranged at the correct position relative to the sheet material 100B and hence the perforations 301 and 302 can be formed at the desired positions. Thus, processing in the width direction can accurately be performed.

(3) As shown in FIGS. 4 and 5, in the sheet material processing device 3, the blade member 4 is attachable and detachable. Thus, the blade member 4 can be changed to a blade member 4 of different type. Here, the expression that the type of the blade member 4 is different indicates that the type of processing of the processing blade 421 and/or the position of the processing blade 421 in the width direction and/or the number of the processing blades 421 is different.

(4) As shown in FIG. 4, attaching and detaching of the blade member 4 is achieved by the sliding mechanism. Thus, attaching and detaching can be performed easily and smoothly.

Figure 11:
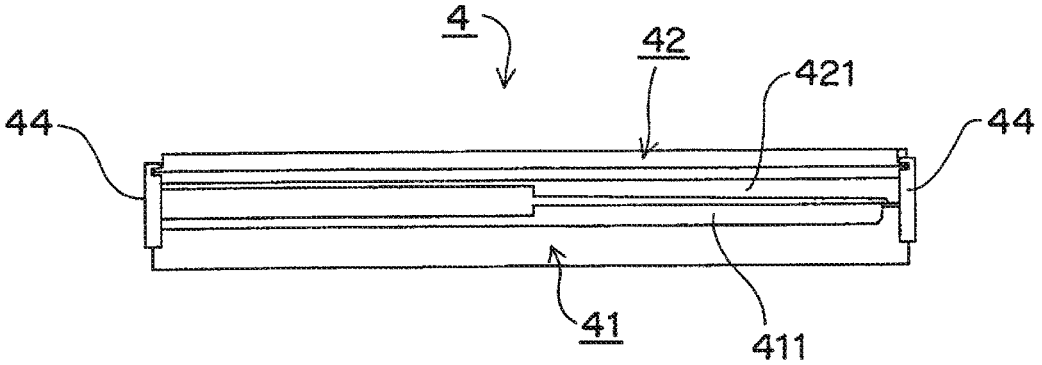
FIG. 11 is a front view of a blade member of a first other example.
Figure 14:
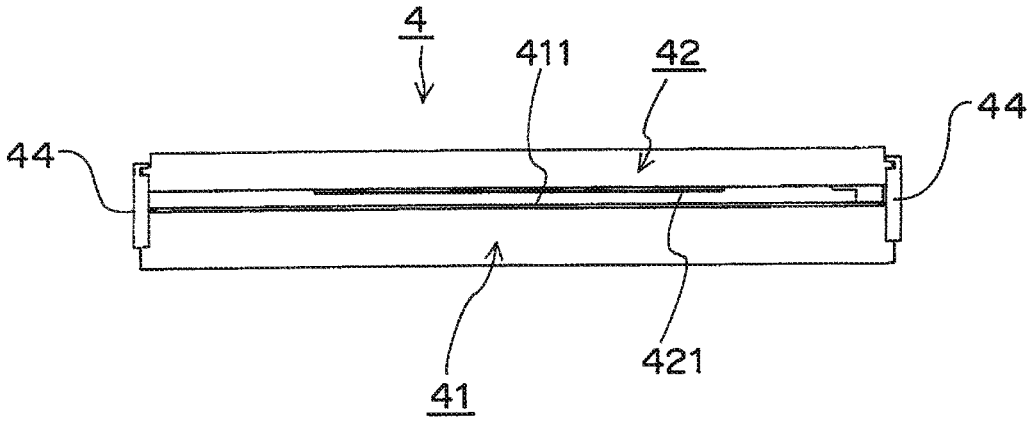
FIG. 14 is a front view of a blade member of a second other example.

(5) In addition to the blade member 4 of FIG. 6 given above, employable blade members 4 include a blade member 4 of FIG. 11 and a blade member 4 of FIG. 14 as described in other examples given later. Thus, in the sheet material processing device 3, an arbitrary blade member 4 may be selected and employed from among these blade members 4 so that various kinds of processing can be dealt with.

(Other Examples of Blade Member)

Figure 12:
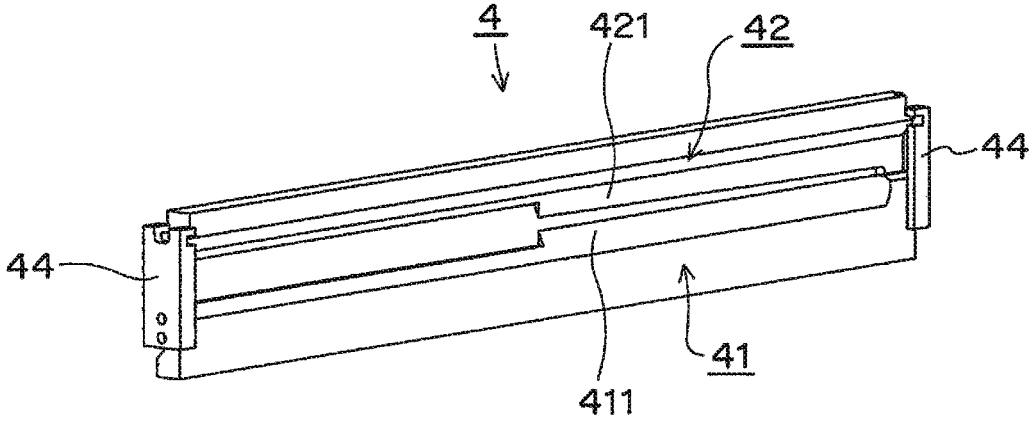
FIG. 12 is a perspective view of a blade member of a first other example.
Figure 13:
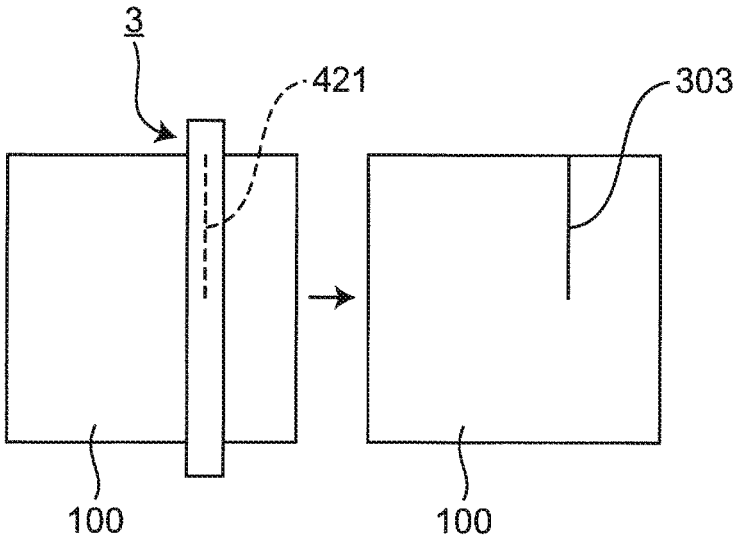
FIG. 13 is a schematic plan view showing a situation of processing of a sheet material in a sheet material processing device having a blade member of a first other example.

(A) The blade member 4 may be one whose type of predetermined processing is cutting. FIG. 11 is a front view of the blade member 4 of a first other example. FIG. 12 is a perspective view of this. In this blade member 4, in the upper blade part 42, a cutting blade serving as the processing blade 421 is provided in the right-side section among sections obtained by dividing into two in the width direction. Then, in the lower blade part 41, a cutting blade serving as the processing blade 411 is provided over the section facing the processing blade 421 of the upper blade part 42 from the underside. In the blade member 4, when the processing blade 411 and the processing blade 421 are ground together, cutting is achieved. Thus, according to the blade member 4, as shown in FIG. 13, the right half of the sheet material 100 can be cut in the perpendicular direction so that a cut 303 can be formed.

Figure 15:
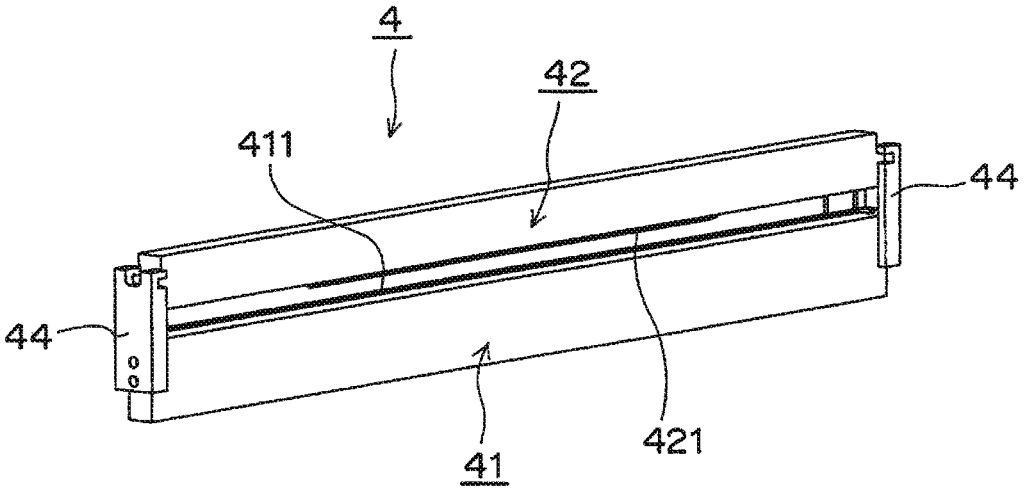
FIG. 15 is a perspective view of a blade member of a second other example.
Figure 16:
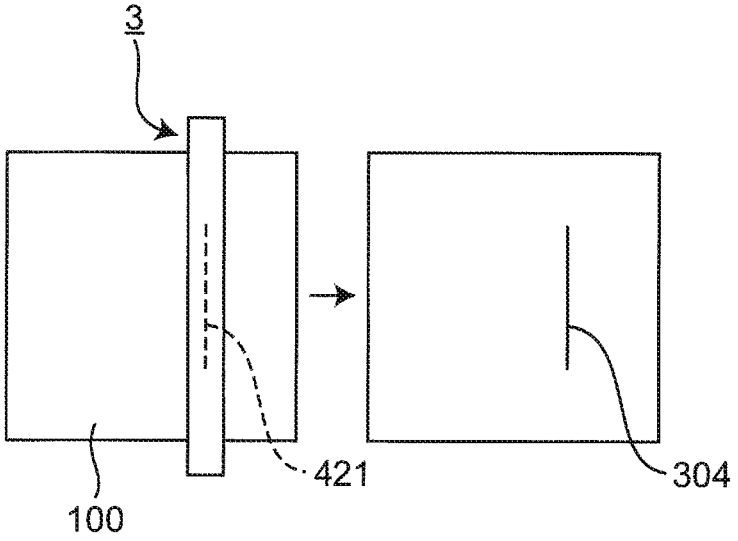
FIG. 16 is a schematic plan view showing a situation of processing of a sheet material in a sheet material processing device having a blade member of a second other example.

(B) The blade member 4 may be one whose type of predetermined processing is crease formation. FIG. 14 is a front view of the blade member 4 of a second other example. FIG. 15 is a perspective view of this. In this blade member 4, in the upper blade part 42, a crease blade serving as the processing blade 421 is formed in the second and the third section (i.e., in the center section) from the left among sections obtained by dividing into four in the width direction. Here, in the lower blade part 41, a receiving part 411 for the processing blade 421 is provided at least over the section facing the processing blade 421 of the upper blade part 42 from the underside. Thus, according to the blade member 4, as shown in FIG. 16, a crease 304 extending in the perpendicular direction can be formed in the center region of the sheet material 100.

Figure 17:
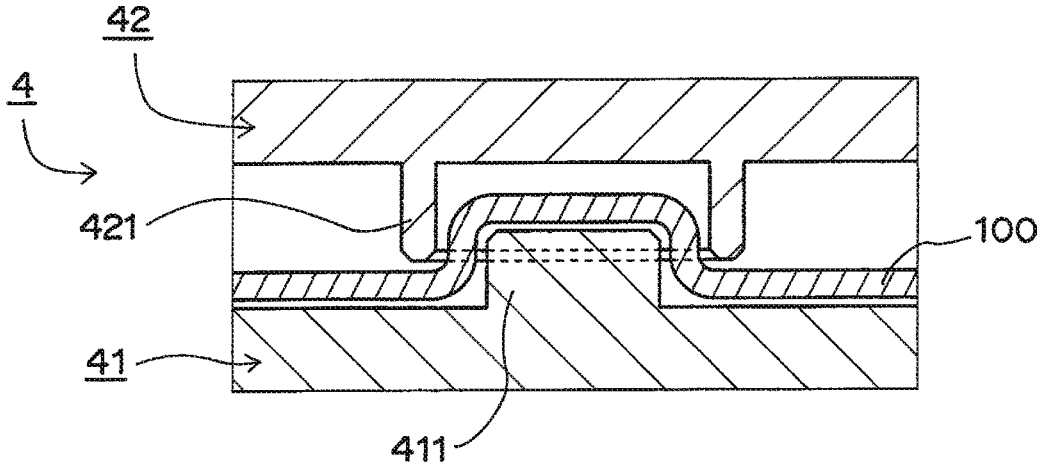
FIG. 17 is a sectional front view of a processing blade and a receiving part of a blade member of a third other example.
Figure 18:
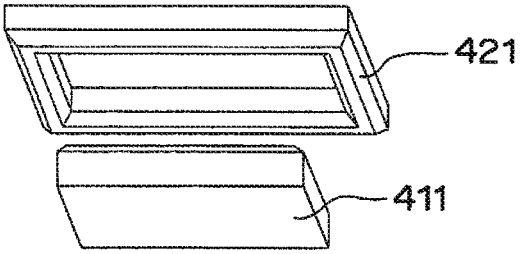
FIG. 18 is an underside perspective view of a processing blade and a receiving part of FIG. 17.
Figure 19:
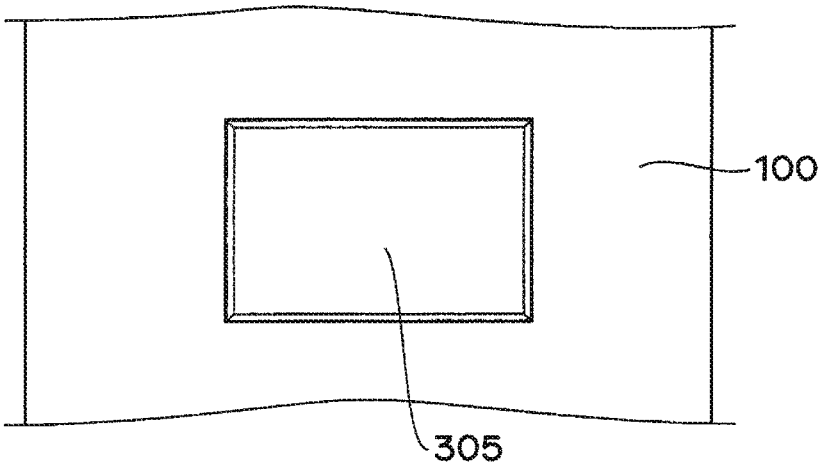
FIG. 19 is a plan view showing a protrusion formed by a blade member of FIG. 17.

(C) The blade member 4 may be one whose type of predetermined processing is emboss formation. FIG. 17 is a sectional front view of the processing blade 421 and the receiving part 411 of the blade member 4 of a third other example. FIG. 18 is an underside perspective view of the processing blade 421 and the receiving part 411. The receiving part 411 is constructed from a rectangular protrusion of predetermined area. Then, the processing blade 421 is constructed from a ridge along the four sides of the receiving part 411. According to the blade member 4, as shown in FIG. 19, a protrusion 305 can be formed in a predetermined region of the sheet material 100.

Figure 20:
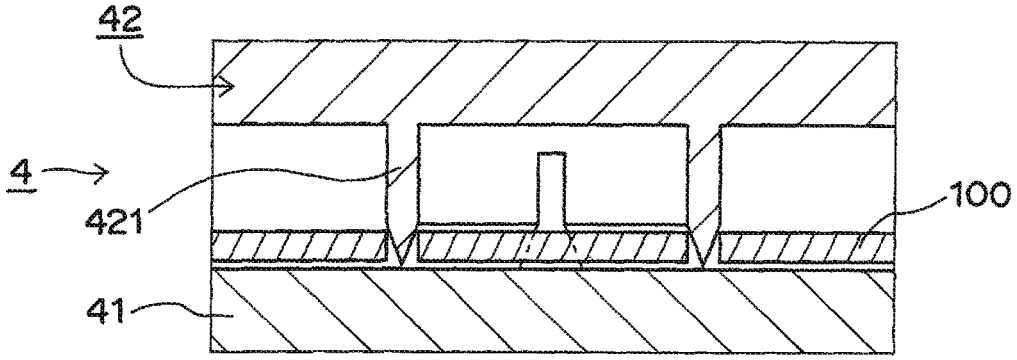
FIG. 20 is a sectional front view of a processing blade and a lower blade part of a blade member of a fourth other example.
Figure 21:
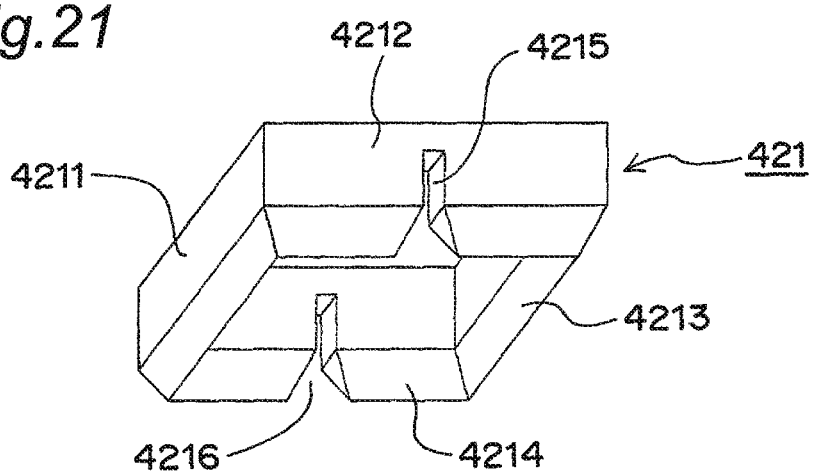
FIG. 21 is an underside perspective view of a processing blade of FIG. 20.
Figure 22:
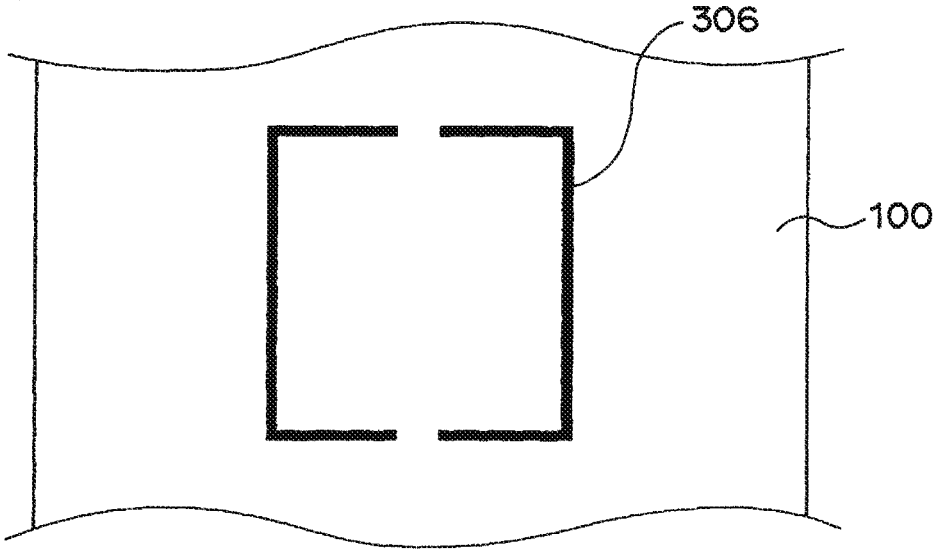
FIG. 22 is a plan view showing cutout formed by a processing blade of FIG. 20.

(D) The blade member 4 may be one whose type of predetermined processing is cutout formation. FIG. 20 is a sectional front view of the processing blade 421 and the lower blade part 41 of the blade member 4 of a fourth other example. FIG. 21 is an underside perspective view of the processing blade 421. The processing blade 421 is constructed from protruding blades 4211, 4212, 4213, and 4214 constituting the four sides of a rectangle. Then, notches 4215 and 4216 are formed in the protruding blades 4212 and 4214 corresponding to two sides opposite to each other. According to the blade member 4, as shown in FIG. 22, a cutout 306 can be formed in a predetermined region of the sheet material 100.

(Modifications)

(1) In the embodiment given above, the sheet material processing device 3 has performed processing at one site in the conveyance direction. Instead, the sheet material processing device 3 may perform processing at two or more sites in a required number in the conveyance direction.

(2) In the embodiment given above, the pressing mechanism 5 of the sheet material processing device 3 has been constructed such as to press the upper blade part 42 against the lower blade part 41. Instead, the pressing mechanism 5 of the sheet material processing device 3 may be constructed such as to press the lower blade part 41 against the upper blade part 42 or, alternatively, may be constructed such that both blade parts 41 and 42 are pressed against each other.

(3) In addition to the edge part cutting device 2 and the sheet material processing device 3, the sheet material processing apparatus 1 may include one or more arbitrary kinds of the following processing devices.

a conveyance directional cutting device for performing cutting along the conveyance direction a conveyance directional crease processing device for forming a crease along the conveyance direction a conveyance directional perforation processing device for forming a perforation along the conveyance direction a width directional cutting device for performing cutting over the entire width directional section along the width direction a width directional crease processing device for forming a crease over the entire width directional section along the width direction a width directional perforation processing device for forming a perforation over the entire width directional section along the width direction (4) In the embodiment given above, a configuration has been employed that in a state that the sheet material processing device 3 has been extracted from the receiving part 110, the blade member 4 can be attached or detached through the side plate opening part (not shown) of the left side plate 33. Instead, a configuration may be employed that the blade member 4 can be attached or detached in a state that the sheet material processing device 3 is installed in the inside of the receiving part 110. In this case, in the wall 112 of the apparatus body 10, a body opening part (not shown) is formed at a position facing the side plate opening part (not shown) of the left side plate 33 so that the blade member 4 is attached or detached through the side plate opening part and the body opening part.

(5) In the embodiment given above, the drive part 62 of the moving mechanism 6 has been constructed such that the blade member 4 is moved by the motor (not shown). Instead, the drive part 62 may be constructed such that the blade member 4 is moved by manual operation. Specifically, for example, an adjust knob is provided in place of the gear 631 (FIG. 4). In this case, first, the user performs trial processing on one sheet of the sheet material and then checks deviation in the processing position. Then, when no deviation has been found, the processing is continued in this state. On the other hand, when deviation has been found, the adjust knob is operated so that the blade member 4 is moved in the width direction by an amount corresponding to the deviation.

(6) In the embodiment given above, the blade member 4 has been constructed such that the lower blade part 41 and the upper blade part 42 move together in the width direction. Instead, the blade member 4 may be constructed such that either the lower blade part 41 or the upper blade part 42 alone moves in the width direction. For example, in a case that the upper blade part 42 includes a processing blade formed in apart alone in the width direction and the lower blade part 41 includes a processing blade formed over the entire width direction, a configuration may be employed that the upper blade part 42 alone moves in the width direction. In this case, specifically, the vertical cover 44 (FIG. 4) is divided into two in the up and down directions and then the upper vertical cover and the lower vertical cover are locked together in a manner of being movable in the width direction and not movable in the up and down directions by spline fitting or the like. Further, the magnet 624 (FIG. 4) is provided in the upper vertical cover for holding the upper blade part 42. Here, in a case that the lower blade part 41 includes a processing blade formed in a part alone in the width direction and the upper blade part 42 includes a processing blade formed over the entire width direction, on the contrary to the above-mentioned case, the lower blade part 41 alone is constructed such as to move in the width direction.

(7) In the present invention, shown in FIG. 9, when the cut mark 105 has been printed at a position deviated from the correct position (the reference S), the blade member 4 has been moved in the width direction so that correction for the amount of deviation has been performed. Then, the present invention may be constructed such that when the amount of correction exceeds a limit, an error is notified. Here, the "limit" indicates a distance that the blade member 4 can move in the width direction at maximum. Further, the "notification of error" indicates that, for example, a warning of unachievable correction is displayed on an operation panel or alternatively a warning sound is generated from a speaker. Here, this configuration may be employed in both of a case that the drive part 62 of the moving mechanism 6 is operated by the motor and a case that the drive part 62 is operated by manual operation.

INDUSTRIAL APPLICABILITY

The sheet material processing device of the present invention can accurately perform processing in the width direction and hence has a high industrial utility value.

DESCRIPTION OF REFERENCE NUMERALS

1: Sheet material processing apparatus, 3: Sheet material processing device, 4: Blade member, 41: Lower blade part, 42: Upper blade part, 421: Processing blade, 5: Pressing mechanism, 6: Moving mechanism, 100: Sheet material

The invention claimed is:

1. A sheet material processing apparatus, comprising:

a conveyor; and a sheet material processing device, whereby the conveyor is configured for conveying a sheet material to be conveyed in a conveyance direction and then a predetermined processing is to be performed thereon by the sheet material processing device, wherein the conveyor and the sheet material processing device are provided in an apparatus body, the apparatus body including a side plate arranged at each side in a width direction, wherein the sheet material processing device comprises:

an outer frame constructed from a top plate, right and left side plates, and a bottom frame;

a first blade member including a first upper blade part and a first lower blade part each having a length extending in a first direction with respect to the conveyor and configured to press the both blade parts to each other so as to perform predetermined processing on the sheet material located between the both blade parts;

a pressing mechanism for pressing the both blade parts to each other in a second direction perpendicular to the first direction; and a moving mechanism for moving the first upper blade part and/or the first lower blade part of the blade member relative to the apparatus body in the first direction with respect to the conveyor, wherein the first direction is the width direction perpendicular to the conveyance direction, wherein in one of the first upper blade part and the first lower blade part, a first processing blade for performing the predetermined processing is formed at one or more sites in the first direction, and wherein in the other one of the first upper blade part and the first lower blade part, a receiving part for the first processing blade or alternatively a second processing blade for performing the predetermined processing is formed at least over a section facing the first processing blade a support arranged between the side plates of the apparatus body, the support including a first slide receiving part and a second slide receiving part, each slide receiving part arranged in the width direction, the first upper blade part configured to slide in the width direction in the first slide receiving part and the first lower blade part configured to slide in the width direction in the second slide receiving part, the support configured to maintain a position relative to the side plates when the first upper blade part and first lower blade part slide in the respective slide receiving parts, wherein when the sheet material cut at a position deviated in the width direction from the correct position is conveyed by the conveyor, the moving mechanism is configured to arrange the first upper blade part and/or the first lower blade part at the correct position relative to the sheet material, wherein the blade member can move in the width direction within an inner space of the outer frame, and wherein the pressing mechanism and the moving mechanism are fixed to the outer frame.

2. The sheet material processing apparatus according to claim 1, wherein the moving mechanism is configured to move the first upper blade part and the first lower blade part of the blade member in the first direction.

3. The sheet material processing apparatus according to claim 2, wherein the first blade member is provided in an attachable and detachable manner.

4. The sheet material processing apparatus according to claim 3, wherein the first blade member is constructed in an attachable and detachable manner by means of a sliding mechanism.

5. A kit for the sheet material processing apparatus according to claim 2, comprising:

at least one second blade member including a second upper blade part and a second lower blade part, in one of the second upper blade part and the second lower blade part, a third processing blade for performing predetermined processing is formed at one or more sites and in the other one of the second upper blade part and the second lower blade part, a second receiving part for the third processing blade or alternatively, a fourth processing blade for performing the predetermined processing is formed at least over a section facing the third processing blade, the at least one second blade member being configured to be exchanged with the first blade member, the at least one second blade member being different from the first blade member in at least one of a type of processing of the first processing blade, and a position of the first processing blade in a first direction and a number of processing blades.

6. The sheet material processing apparatus according to claim 2, wherein the first blade member is constructed such that the predetermined processing is performed at the one or more sites at once by a single operation of the pressing mechanism.

7. The sheet material processing apparatus according to claim 1, wherein the sheet material processing device is attachable and detachable relative to a body of the sheet material processing apparatus.

* * * * *